US005250998A

United States Patent [19]

Ueda et al.

[11] Patent Number: 5,250,998

[45] Date of Patent: Oct. 5, 1993

[54] FIXING APPARATUS HAVING TWO NIP REGIONS

[75] Inventors: Masato Ueda, Hino; Tadashi Miwa; Satoshi Haneda, both of Hachioji; Yasuhiko Tanaka, Kodaira; Kiyoaki Kawamoto, Kunitachi; Tetsuko Omoto, Kokubunji; Toshinori Yamazaki; Masakazu Fukuchi, both of Hachioji; Shizuo Morita, Tachikawa, all of Japan

[73] Assignee: Konica Corporation, Tokyo, Japan

[21] Appl. No.: 840,539

[22] Filed: Feb. 25, 1992

[30] Foreign Application Priority Data

| | | | |
|---|---|---|---|
| Feb. 28, 1991 | [JP] | Japan | 3-34471 |
| May 20, 1991 | [JP] | Japan | 3-114745 |
| May 20, 1991 | [JP] | Japan | 3-114746 |
| May 20, 1991 | [JP] | Japan | 3-114747 |

[51] Int. Cl.[5] ..... G03G 15/20

[52] U.S. Cl. ..... 355/285; 219/216; 355/290

[58] Field of Search ..... 355/282, 284, 285, 290, 355/295, 275, 279; 219/469, 216; 118/60; 432/60

[56] References Cited

U.S. PATENT DOCUMENTS

| | | | |
|---|---|---|---|
| 3,810,735 | 5/1974 | Moser | 432/59 |
| 4,455,079 | 6/1984 | Miwa et al. | 355/295 X |
| 4,542,978 | 9/1985 | Tarumi et al. | 355/279 |
| 4,563,073 | 1/1986 | Reynolds | 219/216 X |
| 4,780,742 | 10/1988 | Takahashi et al. | 219/216 X |
| 4,905,051 | 2/1990 | Satoh et al. | 355/290 |
| 5,085,962 | 2/1992 | Aslam et al. | 355/282 X |

FOREIGN PATENT DOCUMENTS

| | | | |
|---|---|---|---|
| 60-151676 | 12/1985 | Japan . | |
| 1-83659 | 7/1989 | Japan | 355/279 |
| 0039057 | 2/1990 | Japan | 355/282 |
| 0158780 | 6/1990 | Japan | 355/290 |
| 0162383 | 6/1990 | Japan | 355/290 |
| 0220555 | 9/1991 | Japan | 355/285 |
| 0032843 | 2/1992 | Japan | 355/285 |

*Primary Examiner*—A. T. Grimley
*Assistant Examiner*—William J. Royer
*Attorney, Agent, or Firm*—Finnegan, Henderson, Farabow, Garrett & Dunner

[57] ABSTRACT

In a toner image fixing device, there are provided an endless belt being looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

8 Claims, 6 Drawing Sheets

FIXING APPARATUS HAVING TWO NIP REGIONS

BACKGROUND OF THE INVENTION

The present invention relates to a means for preventing undesirable transfer caused by offsetting phenomenon which occurs in a fixing device of an electrophotographic apparatus, and relates to a means for giving gloss to a color image provided by electrophotography.

In a fixing process for a toner image formed by means of electrophotography, a heating roller fixing method is most commonly adopted. In recent electrophotographic apparatus by which color images are copied, it is required to fuse toner completely in order to ensure color reproducibility and give a sufficient gloss to an image, or in order to ensure color transmission when the transferred sheet is to be used in an OHP. When fixing is performed, using a widely known toner made of linear polyester under the condition satisfying the aforementioned matters, it is essential to apply a large amount of silicone oil of low viscosity as a releasing agent in order to prevent offsetting phenomenon from occurring at high temperature.

When a large amount of silicone oil is used in the manner mentioned above, various problems are caused such as spillage of silicone oil, adhesion of silicone oil to transfer sheets, and the like. Especially when an obtained image is used in an OHP, the applied silicone oil is not sufficiently impregnated into a transfer sheet, so that the operator's hands become dirty easily, and the transmission property of OHP sheets is deteriorated remarkably. Therefore, a toner in which common polyester is used, in other words, a toner composed of wax, has been adopted. However, a sufficient toner fusing condition can not be obtained at present. As described above, in the case of a color toner image, a glossy surface is often required. According to the prior art, in order to obtain a glossy surface, a large amount of releasing agent is coated as described above, or an image once fixed is fixed again by an optional unit in the case of a common polyester toner, that is, a toner composed of wax.

In order to avoid this inconvenience, toner in fused condition is cooled in such a manner that: an endless belt is provided between a roller, which is one of a pair of fixing rollers, and a conveyance roller; a developed transfer sheet passes around the fixing roller and the conveyance roller; and the fused toner is cooled and solidified onto the surface of the transfer sheet while it passed between the rollers. In this case, it is necessary to appropriately position the pair of rollers and adjust the temperatures of the belt and conveyance roller. In order to realize this, it is necessary to provide a precise sensor to detect and control the temperature. However, when the temperature sensor is directly contacted with the belt, the formed toner image is damaged, and dust or toner is adhered onto the sensor, so that a faulty operation of the sensor is caused and control can not be performed sufficiently.

It is the first object of the present invention to solve these problems and provide a fixing device in which a releasing agent such as silicone oil is not used at all, or an extremely small amount of releasing agent is used, and in which toner fusion is sufficiently ensured after the fixing operation, so that color reproducibility is excellent. Further, the first object of the present invention is to accomplish a fixing operation in which a glossy color image can be obtained and transmission by an OHP is excellent, and further, color reproducibility is improved.

A thermal fixing device for a toner image, especially a fixing device in which fixing is conducted through a belt, is disclosed in the official gazette of the Japanese Patent Application Open to Public Inspection No. 36342/1974. This device is structured in such a manner that: a heating roller is encircled by a belt; a pressure roller is disposed in opposition to the heating roller; and a transfer sheet on which a toner image is formed, is pinched and conveyed between the pressure roller and the belt so that fixing can be conducted. In this case, however, sufficient nip region $N_1$ can not be obtained. Further, a sufficient amount of heat can not be supplied from the heating roller to the toner through the belt. Therefore, toner fusion is not sufficient to obtain a glossy surface of the image.

A fixing device by which fixing is conducted through a belt, is also disclosed in the official gazette of the Japanese Patent Application Open to Public Inspection No. 122665/1986. In this case, also, the length of nip region $N_2$ formed by the belt with regard to the pressure roller, is not sufficient. Consequently, a sufficient period of time can not be obtained for fusing, so that heating of the transfer sheet is not sufficient. Accordingly, the fixing property depends on the material and thickness of the transfer sheet, and the thermal fusing operation is not stable.

The second object of the present is to provide a fixing device by which glossy fixing can be stably performed, wherein the thermal fixing property of a toner image does not depend on the material and thickness of a transfer sheet, and by which a color toner image of high quality can be obtained without causing offsetting phenomenon in the transfer operation.

SUMMARY OF THE INVENTION

The aforementioned first object can be accomplished by the following technical method and means.

The first object of the present invention is to provide a method for fixing by which toner is fixed on a transfer sheet when the transfer sheet, having thereon an unfixed electrophotographic toner image, passes between a pair of rollers, at least one of which is heated, and along the peripheral surface of an endless belt which is provided between one of the pair of rollers and a conveyance roller located at a predetermined distance from the pair of rollers, wherein the pair of rollers contact each other with pressure through the endless belt, and the fixing method is characterized in that: a surface release agent layer is provided on the surface of the endless belt in order to make it easy to peel off the transfer sheet from the endless belt; sensors are provided, being respectively contacted with portions on the peripheral surfaces of the pair of rollers where the endless belt does not come into contact, in order to detect the temperature of the peripheral surfaces of the rollers; and an appropriate amount of heat is given to the rollers so that the toner can be melted and solidified appropriately so as to prevent the image and the sensors from being stained by toner, and to avoid the occurrence of offset transfer.

The present invention is to provide a fixing apparatus by which toner is fixed on a transfer sheet when the transfer sheet having an unfixed toner image of electrophotography passes between a pair of rollers and along the peripheral surface of an endless belt which is provided between one of the pair of rollers and a conveyance roller located at a predetermined distance from the pair of rollers, wherein the pair of rollers are contacted with each other with pressure through the endless belt, and wherein a heater is provided to at least one of the pair of rollers, and the aforementioned fixing apparatus is characterized in that: the aforementioned endless belt is composed of a base coated with a surface release agent layer; and a temperature detecting means is provided, being contacted with a portion on the peripheral surface of the roller provided on the heating side, wherein the endless belt does not come into contact with the portion.

The heater is controlled according to the value measured by the aforementioned temperature detecting means.

The second object can be accomplished in a fixing device having an endless belt which encircles a heating roller and a peeling roller, a pressure roller coming into contact with the heating roller with pressure through the endless belt to fix a toner image carried on a transfer sheet, and the fixing device comprises: a first nip region $N_1$ formed by the heating roller, the pressure roller and the endless belt; a second nip region $N_2$ formed by the endless belt and the pressure roller; and a pushing means for the endless belt, which is disposed inside the endless belt downstream of the second nip region $N_2$, whereby the second nip region $N_2$ is formed by the position of the pushing means.

That is a fixing device having a heated endless belt which wraps a heating roller and a peeling roller, a pressure roller coming into contact with the heating roller with pressure through the endless belt to fix a toner image carried on a transfer sheet, and the aforementioned fixing device comprises: the first nip region $N_1$ formed by the heating roller, the pressure roller and the heated endless belt; the second nip region $N_2$ formed by the heated endless belt and the pressure roller; a pushing means for the endless belt, which is disposed inside the endless belt in the downstream of the second nip region $N_2$, wherein the second nip region $N_2$ is formed by the aforementioned pushing means; and a cooling means to cool the aforementioned pushing means.

That is a fixing device having a heated endless belt which wraps a heating roller and a peeling roller, a pressure roller coming into contact with the heating roller with pressure through the endless belt to fix a toner image carried on a transfer sheet, and the aforementioned fixing device comprises: the first nip region $N_1$ formed by the heating roller, the pressure roller and the heated endless belt; and the second nip region $N_2$ formed by the heated endless belt and the pressure roller, wherein ratio $N_2/N_1$ satisfies the following inequality.

$$1 \leqq N_2/N_1 \leqq 3$$

That is a fixing device having a heated endless belt which wraps a heating roller and a peeling roller, a pressure roller coming into contact with the heating roller with pressure through the endless belt to fix a toner image carried on a transfer sheet, and the aforementioned fixing device comprises: the first nip region $N_1$ formed by the heating roller, the pressure roller and the heated endless belt; and the second nip region $N_2$ formed by the heated endless belt and the pressure roller, wherein complementary angle $\alpha$ of the angle formed by a line connecting the centers of the aforementioned two rollers and a line formed by the endless belt running from the two rollers to the peeling roller, satisfies the following inequality.

$$5° < \alpha < 40°$$

That is a fixing device having a heated endless belt which wraps a heating roller and a peeling roller, a pressure roller coming into contact with the heating roller with pressure through the endless belt to fix a toner image carried on a transfer sheet, and the aforementioned fixing device comprises: the first nip region $N_1$ formed by the heating roller, the pressure roller and the heated endless belt; the second nip region $N_2$ formed by the heated endless belt and the pressure roller, wherein complementary angle $\alpha$ of the angle formed by a line connecting the centers of the aforementioned two rollers and a line of the endless belt running from the two rollers to the peeling roller, satisfies the inequality of $5° < \alpha < 40°$; and an entry guide which guides the transfer sheet into the first nip region $N_1$.

DETAILED DESCRIPTION OF THE PREFERRED EMBODIMENTS

Figure 1:
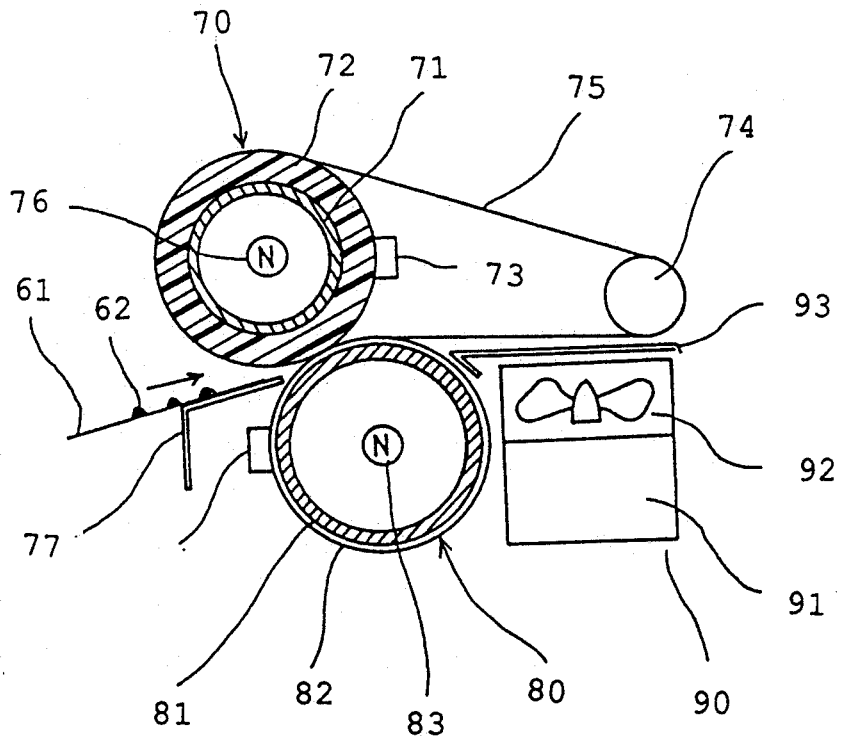
FIG. 1 is a sectional view of an embodiment of the present invention.

As shown in FIG. 1, a fixing roller 70 is structured in such a manner that: the fixing roller 70 is provided with a core 71; a heat resisting synthetic rubber layer is coaxially provided around the core 71 so that it functions as a resilient layer 72; and a heater 76 is provided in the center of the fixing roller 70. An endless belt 75 encircles the fixing roller 70 and a conveyance roller 74 which is disposed separately from the fixing roller 70 by a specific distance. The endless belt 75 is composed of a polyimide base on which a surface lubricant layer made of silicone rubber is coated. The thickness of the polyimide base is preferably 10–100 μm, and more preferably 20–50 μm. The thickness of the silicon rubber layer is 50–300 μm. A fixing roller 80 is contacted with the fixing roller 70 with pressure through the aforementioned endless belt 75. An inclination angle of a line connecting the centers of both fixing rollers 70 and 80 is 5°–45° with regard to the vertical. A heater 83 is disposed in the center of the fixing roller 80, and a core 81 is coaxially provided around the heater 83. A heat resisting synthetic rubber lining is provided around the core 81 so that it functions as a resilient layer 82.

A transfer sheet 61 onto which toner 62 is adhered so as to form an image, is conveyed onto an entry guide 77, wherein the toner image has already been developed and has not been fixed yet. The transfer sheet 61 is conveyed in the direction of an arrow being pressed by the fixing rollers 70, 80 and the endless belt 75. After that, the transfer sheet 61 is conveyed through a guide 93 and discharged outside by a conveyance roller 74.

A cooling device 90 including an air suction duct 91 and a cooling fan 92, is disposed downward between the fixing rollers 70, 80 in such a manner that the cooling device 90 is located close to the guide 93.

The outside of the endless belt 75 is coated with silicone rubber which functions as a releasing agent and a resilient body.

Sensors 73 for use in a temperature detecting means are provided, contacted with the outer peripheral surfaces of the fixing roller 70 and the heating roller 70. In this case, the sensors 73 are disposed in positions on the fixing roller 70 and the heating roller 70 with which the endless belt 75 does not come into contact. A contact type of thermistor or a thermo-couple is preferably used for the sensor 73.

The working action of the fixing device composed in the manner described above, will be explained as follows.

Figure 2:
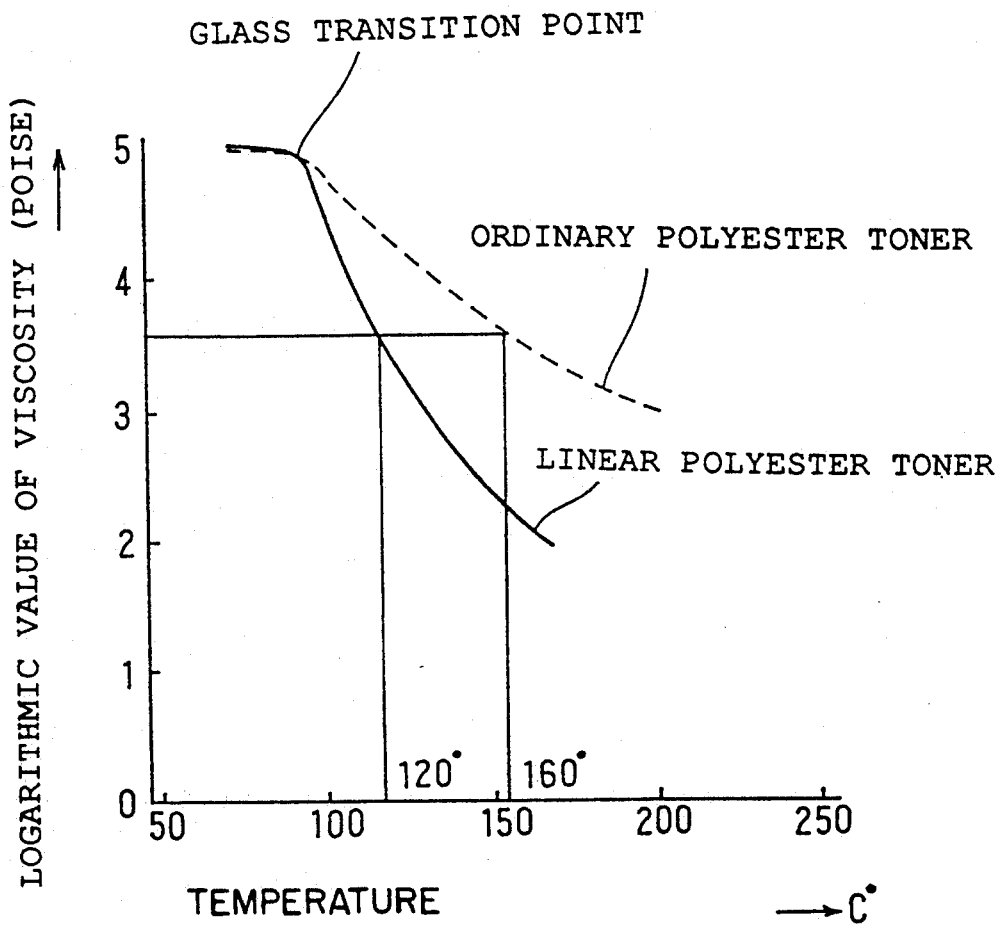
FIG. 2 is a viscosity-temperature characteristic curve of toner.

First, a characteristic curve in FIG. 2 which shows the viscosity-temperature characteristic of toner made of linear polyester and that of toner made of common polyester, in other words, toner made of wax, will be explained.

In this graph, the vertical axis represents viscosity, by a common logarithm, and is graduated in poise. The horizontal axis represents temperature. The solid line in the graph represents a characteristic curve of toner made of polyester, and the broken line represents a characteristic curve of toner made of common polyester. At a temperature of 100° C., the viscosities of both toners are as high as 100,000 poise, that is, both toners are in the condition of glass dislocation. When the temperature exceeds 100° C., both toners are melted. The most appropriate melting condition can be obtained when the viscosity is about 5000 poise. In the case of a common polyester toner, the most appropriate melting condition is obtained at a temperature of 150° C. However, in the case of linear polyester toner, the same melting condition can be obtained at a lower temperature of 120° C.

As compared with a conventional fixing device in which thermal fixing is conducted only in a nip portion composed by a pair of fixing rollers, the fixing device of the present invention is provided with the endless belt 75 by which the temperature of a transfer sheet can be decreased while the transfer sheet is being conveyed on the endless belt 75. Therefore, the melting temperature can be higher than that of the conventional method, and the heating region can be further extended. When linear polyester resin is used for toner, an unfixed toner image can be sufficiently melted in the melting region. The transfer sheet 61 and toner 62 are conveyed by the endless belt 75, being adhered onto the surface of the endless belt 75 by the adhesion between the melted toner 62 and the transfer sheet 61, and the air flow sent from the cooling fan 92 to the reverse side of the transfer sheet. While the transfer sheet 61 is conveyed by the endless belt 75 in the aforementioned manner, the temperature of the transfer sheet 61 is decreased due to the decrease in temperature of the endless belt itself and the action of the air flow generated by the cooling fan.

The toner 62 is sufficiently cooled in the aforementioned region and the viscosity is increased so that the toner 62 is in a state of glass dislocation. The transfer sheet 61 onto which the aforementioned toner is adhered, is separated from the belt 75 at the end portion of the endless belt 75 which is supported by the conveyance roller 74. At this time, the toner 62 is more or less solidified and in the state of glass dislocation, so that the surface property of the endless belt 75 is maintained as it is, and a glossy mirror-like surface can be obtained. As described above, the toner 62 is solidified after it has been sufficiently melted. Therefore, color reproducibility can be ensured when a plurality of toners are melted and mixed. Further, when a toner image is fixed onto an OHP sheet, transmission property can be stably ensured. As described above, the surface of the endless belt 75 is covered with silicone rubber which is a surface release agent, so that the surface release layer itself is resilient. Accordingly, toner can be uniformly heated and pressurized due to the resilience of the surface release layer. At the same time, the surface release layer functions as a buffer between the toner 62 and the endless belt 75. Consequently, even when a toner of low melting point such as linear polyester toner is utilized, an offsetting phenomenon is not caused at all, or even if it is caused, it is extremely small and can be cleaned away later.

Temperature control is effected by a signal sent from the sensor 73, a temperature detection means, which is provided along the peripheral surface of the fixing roller 70 and that of the heating roller 70 with which the endless belt 75 is not contacted. This structure is advantageous in that the surface of the endless belt 75 is not damaged by the sensor 73 at all. Further, the toner 62 is contacted only with the front surface of the endless belt 75, so that the toner 62 does not spread onto the reverse side of the endless belt 75. Accordingly, the toner 62 or dust is not adhered to the sensor 73, and malfunction of the sensor is not caused. Consequently, a great effect can be developed by the apparatus of the present invention as compared with a conventional apparatus in which the sensor 73 is contact with the surface of the endless belt in order to detect the temperature, the surface of the belt is not damaged to deteriorate the image quality and no malfunction is caused by the toner or dust.

In the case of the fixing device in which the endless belt 75 is utilized, the temperature of the fixing portion tends to be affected by the condition of the cooling device 90. However, the heater is controlled according to the temperatures detected by the temperature detecting means 73 and the temperature detecting means provided to the fixing roller 80, so that the temperature of the fixing portion can be maintained in a stable range.

According to the present invention, even when a surface release agent such as silicone oil is not used at all or an extremely small amount of surface release agent is used, offsetting phenomenon due to the silicone oil is not caused, and when a low melting point type of toner is used, the toner is sufficiently melted, a fixed image excellent in transmission and color reproducibility can be obtained, and the image surface is not damaged.

In the aforementioned case, the surface of the transfer sheet is not stained by the silicone oil, and a sufficiently glossy image can be obtained.

Figure 3:
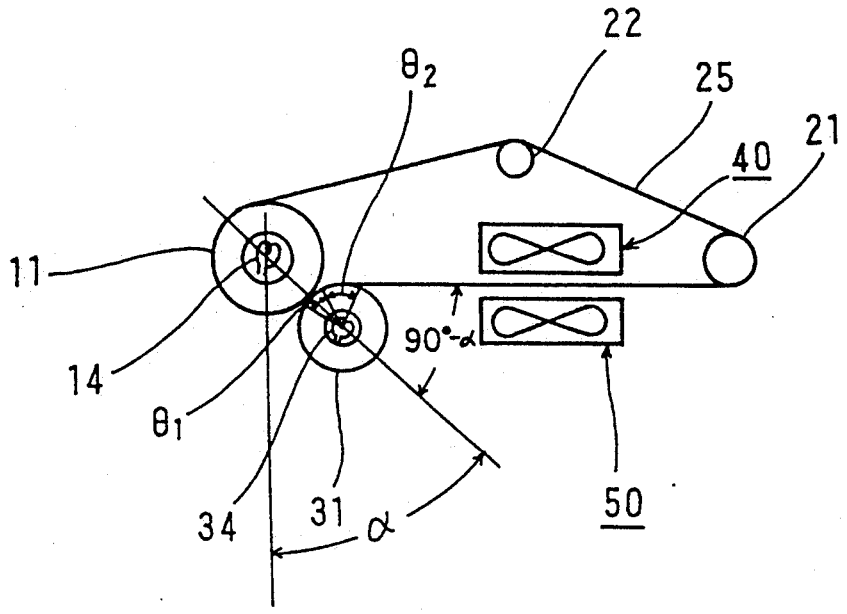
FIG. 3 is a side view showing a nip region of the apparatus of the present invention.

Referring now to FIG. 3 which is a side view showing a nip region, FIG. 4 which is a partially enlarged view, FIG. 5 which is a sectional side view, FIG. 6 which is an exploded perspective view of a cooling section, FIG. 7 which is a sectional view of an upper and a lower fixing roller, and FIG. 8 which is a sectional view showing the composition of belt layers, an example to accomplish the second object of the present invention will be explained as follows.

As shown in FIG. 3, an endless belt 25 is provided around a heating roller 11 having a heater 14 of which the capacity is approximately 400 W, a peeling roller 21, and a tension roller 22. The tension roller 22 is also utilized for preventing skewed running of the endless belt 25. The outside diameters of the peeling roller 21 and the tension roller 22 are set to be 5–20 mm, and in this example, they are 10 mm. A pressure roller 31 pressures a heating roller 11 through the belt 25. Air cooling units 40, 50 are disposed above and below the endless belt 25 between the pressure roller 31 and the peeling roller 21 which is located downstream of the pressure roller 31.

Figure 7:
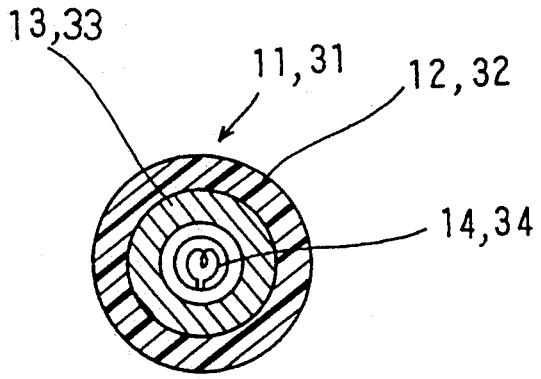
FIG. 7 is a sectional view of a heating roller or a pressure roller.

As shown in FIG. 7, the heating roller 11 and the pressure roller 31 are structured in such a manner that: a core 13, 33 is covered with a synthetic rubber layer 12, 32 so that the outside diameter of the roller can be 40 mm so as to form a soft roller. The heating roller 11 and the pressure roller 31 are pressured against each other so that they are deformed, and nip region $N_1$ corresponding to angle $\theta_1$ is formed by the rollers 11, 31 as shown in FIGS. 3 and 4. Hardness of the rubber layer of the pressure roller 31 is preferably higher than that of the heating roller 11. In some cases, a heater 34 disposed at the center of the pressure roller 31 is omitted.

Figure 4:
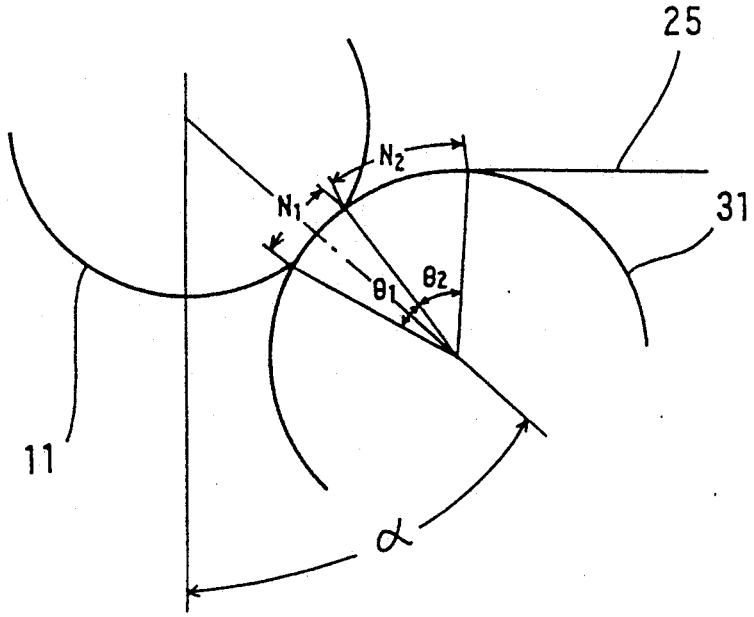
FIG. 4 is a partially enlarged view of the nip portion.

According to the arrangement of the heating roller 11 and the pressure roller 31, angle $\theta_2$ is formed by the endless belt 25 as illustrated in FIGS. 3 and 4, and nip region $N_2$ is formed by the endless belt 25 correspondingly to angle $\theta_2$. The length of nip region $N_1$ is preferably set to be 3–20 mm, and more preferably 3–10 mm. The length of the nip region $N_2$ is preferably set to be 5–50 mm, and more preferably 10–35 mm.

The nip ratio is preferably set to be $1 \leqq N_2/N_1 \leqq 3$.

The angle of a line connecting the center of the heating roller 11 and that of the pressure roller 31 with regard to a vertical line, is defined as $\alpha$ in FIG. 3, which is a complementary angle of the angle formed by the aforementioned line and the straight portion of the endless belt. Angle $\alpha$ is preferably larger than 5° and smaller than 40°.

Figure 5:
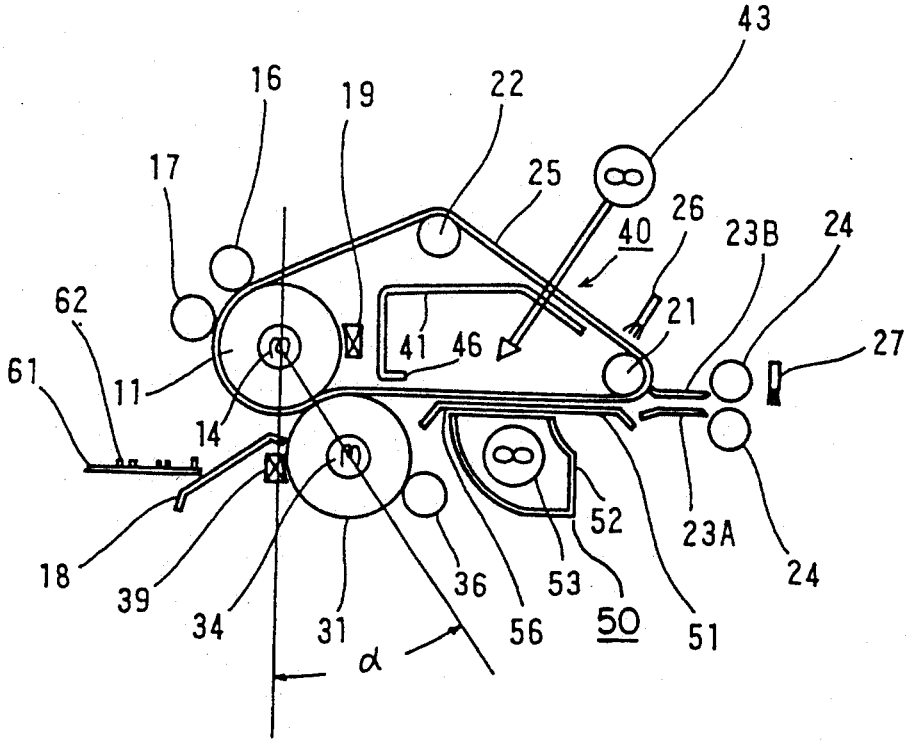
FIG. 5 is a sectional side view of an embodiment of the present invention.
Figure 6:
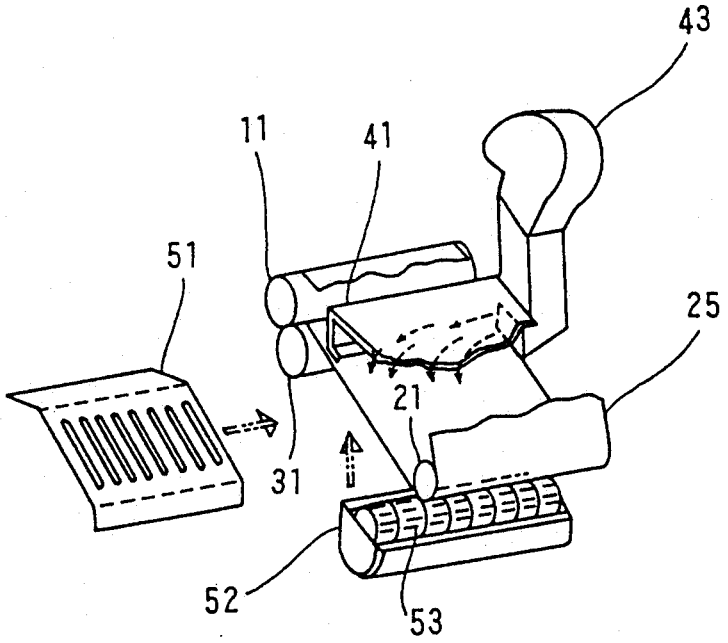
FIG. 6 is an exploded perspective view of a cooling section of the example of the present invention.

In FIG. 5, a transfer sheet 61 having toner 62 on its surface is conveyed as follows: the transfer sheet 61 is conveyed along an entry guide 18 and pinched between a pressure roller 31 and an endless belt 25; then the transfer sheet 61 is conveyed between the endless belt 25 and a guide plate 51 provided with a louver, which is disposed above an air cooling box 52 of a lower air cooling device 50 having a cooling fan 53; the transfer sheet 61 is separated from the endless belt 25 by a separating roller 21; and then the transfer sheet 61 is conveyed between an upper guide 23B and a lower guide 23A, and collected by a pair of rollers 24. An upper air cooling device 40, the fan 43 of which blows air to a duct 41, is provided above the endless belt 25 in the upper portion of the lower air cooling device 50. A plurality of openings are formed in the lower portion of the duct 41 so that the blown air can pass through the openings. The lower portion of the duct 41 comes into contact with the inner surface of the endless belt 25 so that the belt can be air-cooled, and at the same time the duct, which also acts as a bias means, pushes the belt 25 surface downward by a force so as to contribute to form the second nip $N_2$. The lower surface of the duct 41 is coated with Teflon or the like so that the belt 25 can be smoothly moved. As described above, the transfer sheet 61 and toner 62 are cooled from the outside and inside of the endless belt 25 in order to make it easy to peel off the transfer sheet 61 from the endless belt 25.

A cleaning roller 16, the outside diameter of which is 20 mm, and an oil roller 17 are disposed in the upper portion of the heating roller 11, and a cleaning roller 36 is disposed in the lower portion of the pressure roller 31 in the same manner.

A discharging brush 26 is provided close to the peeling roller 21, and a discharging brush 27 is provided in a position where the transfer sheet is delivered by a pair of rollers 24.

A gap 56 formed between the air-cooling box 52 and the guide plate 51 located close to the pressure roller 31, is small, and a gap between an opening 45 of the duct 41 of the upper air-cooling device 40 and the endless belt 25 located close to the heating roller 11, is almost zero. Accordingly, cooling air is not blown out in the direction of the heating roller 11 and the pressure roller 31, so that the surfaces of the rollers are not cooled and the decrease in heating efficiency can be prevented.

A temperature detecting sensor 19 is disposed close to the surface of the heating roller 11, and a temperature detecting sensor 39 is disposed close to the surface of the pressure roller 31.

Figure 8:
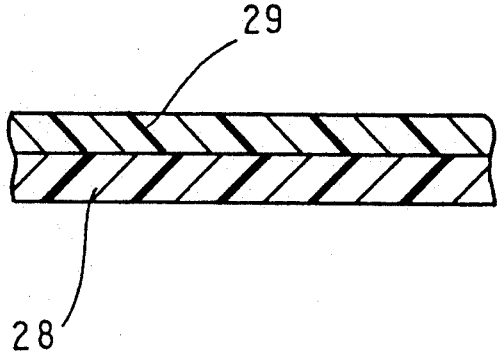
FIG. 8 is a sectional view of an endless belt showing the composition of layers.

As shown in FIG. 8, the endless belt 25 is composed in such a manner that: a surface release agent layer 29 made of silicone rubber is coated on the surface of a base 28 made of polyimide, wherein the thickness of the polyimide layer is 25–75 μm, and the total thickness is 25–150 μm and the width of the belt is 310 mm.

Nip length $N_1$ is necessary in the aforementioned structure for pressing the transfer sheet and melting the toner uniformly. When the toner is heated from the upper side (the inner side) of the endless belt 25, the toner can be positively melted on the interface of the endless belt 25. However, when the toner 62 is heated excessively, it is spread and the toner image is disturbed, and further cooling becomes difficult.

Next, nip length $N_2$ is necessary for sufficiently heating the transfer sheet 61 to melt the toner 62 so that the toner 62 can be sufficiently impregnated into the transfer sheet 61 and fixing property can be increased.

Heating on the toner side is conducted within a short period of time in order to prevent the deterioration in image quality. Accordingly, it is not necessary to provide large pressure to the nip portion, and it is sufficient to melt the toner 62. It is important to gently heat the base side of the endless belt 25 so that the toner can be adhered onto the transfer sheet firmly.

The reason why the lower limit of the aforementioned angle $\alpha$ is set to 5° is that the length of $N_1$ and that of $N_2$ become approximately the same when angle $\alpha$ is 5°. According to an experimental result, it was not preferable that $N_2$ was smaller than $N_1$. The reason why the upper limit of the aforementioned angle $\alpha$ is set to 40° is that: when angle $\alpha$ is larger than 40°, $N_2$ becomes larger than $N_1$, and the toner image is excessively melted and image quality is lowered.

The reason why the upper limit of nip ratio $N_2/N_1$ is set to 3, is to prevent the toner image from melting excessively to cause the deterioration in quality when $N_2$ becomes too large. When $N_2/N_1$ is too large, an angle formed by a transfer sheet located in the entry position and that located in the delivery position becomes too large. Further, in order to ensure a sufficient cooling region for the transfer sheet 61, $N_2/N_1$ can not be made too large. When the value of $N_2/N_1$ is made too large, the size of the apparatus can not be reduced. Further, depending on the kind of recording paper, the more the value of $N_2/N_1$ is increased, the more remarkable the occurrence of curls or wrinkles becomes.

When $N_2$ is made too large, the torque necessary for driving the rollers is increased, so that it is preferable to avoid making $N_2$ too large.

As explained above, when $1 \leqq N_2/N_1 \leqq 3$, or $5° < \alpha < 40°$, fixing can be stably effected in such a manner that: the toner 62 is sufficiently impregnated into the transfer sheet 61; and the surface of toner is sufficiently glossy. In spite of sufficient melting and gloss of the toner, offsetting phenomenon can be eliminated from the endless belt, and accordingly the surfaces of the following papers are not stained at all in a practical operation. Consequently, image fixing of high grade can be stably achieved. The heater 34 may be provided in the center of the pressure roller 31, or the heater 34 may be omitted. In any case, an amount of heat given to the rollers must be controlled according to the information obtained through the surface temperature detecting sensor 39.

According to the fixing apparatus of the present invention, stained offsetting transfer can be eliminated, and a glossy image of high quality without bleeding can be fixed, and especially a color image of high quality can be stably fixed regardless of the material and thickness of the transfer sheet. Further, the fixing apparatus can be made compact and its cost can be reduced.

What is claimed is:

1. An apparatus for fixing a toner image, comprising:

a heating roller including a heater;

a conveyance roller spaced a predetermined distance from said heating roller;

an endless belt looped up around said heating roller and said conveyance roller;

a pressure roller including a heater, for pressing a recording material having the toner image onto said heating roller at a pressing portion with said endless belt intervening between said pressure roller and said heating roller, wherein at least one of said heating roller and said pressure roller is made of rubber so that a first nip region N1 is formed on said pressing portion in which said pressure roller presses said recording material onto said heating roller with said belt over said first nip region; and said pressure roller is relatively disposed in relation to said belt to form a second nip region N2 continuing with said first nip region N1, wherein said pressure roller comes over said second nip region N2 in contact with said belt without pressing said heating roller, and wherein the first nip region N1 and the second nip region N2 satisfy a following relation:

$$1 \leqq (N2/N1) \leqq 3.$$

2. The apparatus of claim 1, further comprising bias means disposed between said heating roller and said conveyance roller for biasing said belt toward said pressure roller so as to form said second nip region.

3. The apparatus of claim 2, further comprising means for cooling said bias means.

4. The apparatus of claim 1, wherein, a first angle is formed between a first straight line connecting both centers of said heating roller and said pressure roller and a second straight line corresponding to a running direction of said belt from an end of said second nip region to said conveyance roller, and a complementary angle $\alpha$ of said first angle satisfies a following relation:

$$5° < \alpha < 40°.$$

5. The apparatus of claim 4, further comprising means for guiding said recording material to said first nip region.

6. The apparatus of claim 1, wherein both of said heating roller and said pressure roller are a soft roller made of rubber.

7. The apparatus of claim 6, wherein a hardness of the rubber of said pressure roller is harder than that of said heating roller.

8. The apparatus of claim 1, wherein one of said heating roller and said pressure roller is a soft roller made of rubber and the other one is a hard roller.

* * * * *